US008177523B2

(12) United States Patent
Patel et al.

(10) Patent No.: US 8,177,523 B2
(45) Date of Patent: May 15, 2012

(54) LINEAR COMPRESSOR

(75) Inventors: Upesh Patel, Auckland (NZ); Gordon Cameron Otte, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 1049 days.

(21) Appl. No.: 11/995,991

(22) PCT Filed: Jul. 21, 2006

(86) PCT No.: PCT/NZ2006/000182

§ 371 (c)(1),
(2), (4) Date: Mar. 31, 2008

(87) PCT Pub. No.: WO2007/011245

PCT Pub. Date: Jan. 25, 2007

(65) Prior Publication Data

US 2008/0213109 A1 Sep. 4, 2008

(30) Foreign Application Priority Data

Jul. 21, 2005 (NZ) ..... 541408

(51) Int. Cl.
*F04B 17/04* (2006.01)
*H02K 15/00* (2006.01)
*H02K 33/00* (2006.01)

(52) U.S. Cl. ..... 417/360; 417/417; 29/596; 310/15; 310/216.131

(58) Field of Classification Search ..... 417/360, 417/417; 310/15, 216.114, 216.129, 216.131; 29/596

See application file for complete search history.

(56) References Cited

U.S. PATENT DOCUMENTS

| | | | | |
|---|---|---|---|---|
| 4,198,743 | A * | 4/1980 | Stuber | 29/596 |
| 5,585,682 | A * | 12/1996 | Konicek et al. | 310/89 |
| 6,077,054 | A | 6/2000 | Lee et al. | |
| 6,956,306 | B2 * | 10/2005 | Yumita et al. | 310/12.01 |
| 7,932,647 | B2 * | 4/2011 | Nakao et al. | 310/15 |
| 2003/0175135 | A1 | 9/2003 | Heo et al. | |

FOREIGN PATENT DOCUMENTS

| | | |
|---|---|---|
| WO | 00/70223 | 11/2000 |
| WO | 01/29444 | 4/2001 |
| WO | 02/35093 | 5/2002 |
| WO | 2004/106737 | 12/2004 |
| WO | 2005/028867 | 3/2005 |

* cited by examiner

*Primary Examiner* — Charles Freay
(74) *Attorney, Agent, or Firm* — Clark Hill PLC

(57) ABSTRACT

A linear compressor includes a cylinder part with a cylinder bore. A piston is disposed in the bore and slidable therein. A main spring connects the cylinder part to the piston. A connecting member connects between the main spring and the piston. The connecting member passes through the air gap of a stator of a linear electric motor. At least one armature pole of the motor is located along the connecting member. The stator comprises a plurality stator parts opposed across the air gap. The cylinder part includes a tapered clamp for each stator part. The tapered clamp widens outward from the air gap. Each stator part has a matching taper and is engaged in the tapered clamp.

20 Claims, 7 Drawing Sheets

LINEAR COMPRESSOR

This application is a National Phase filing of PCT/NZ2006/000182, having an International filing date of Jul. 21, 2006, which disclosure is herein incorporated by reference.

FIELD OF THE INVENTION

The present invention relates to linear compressors, and in particular linear compressors of the type suitable for use in a vapour compression refrigeration system.

BACKGROUND TO THE INVENTION

Linear compressors of a type for use in a vapour compression refrigeration system are the subject of many documents in the prior art. One such document is our co-pending PCT patent application PCT/NZ2004/000108. That specification describes a variety of developments relating to such compressors, many of which have particular application to the linear compressors. The present invention relates to further improvements to compressor embodiments such as are described in that patent application which provides a general exemplification of a compressor to which the present invention may be applied. However the present may also be applied beyond the scope of the particular embodiments of a linear compressor disclosed in that application. Persons skilled in the art will appreciate the general application of the ideas herein to other embodiments of linear compressors such as are found in the prior art.

SUMMARY OF THE INVENTION

It is an object of the present invention to provide improvements relating to linear compressors or to at least provide the industry with a useful choice.

In a first aspect the invention consists in a linear compressor comprising:

a cylinder part including a cylinder bore, a piston disposed in said bore and slidable therein, a main spring connecting said cylinder part to said piston, a connecting member connecting between said main spring and said piston, a stator of a linear electric motor, said stator having an air gap, said connecting member passing through said air gap, at least one armature pole of said linear electric motor located along said connecting member, wherein said stator comprises a plurality stator parts opposed across said air gap, said cylinder part including a tapered clamp for each said stator part, said tapered clamp widening outward from said air gap;

each said stator part having a matching taper and being engaged in a said tapered clamp.

According to a further aspect at least one armature pole comprises one or more substantially flat blocks of permanent magnet material secured to said connecting member with the large faces of said blocks facing the stator, said permanent magnet material magnetised to define said armature poles.

According to a further aspect said tapered clamp includes at least one pair of opposed faces facing toward one another and facing in direction substantially parallel to the reciprocating motion of said piston is said cylinder, said opposed faces being closer adjacent said air gap than away from said air gap.

According to a further aspect said stator part includes a lamination stack, each lamination of same lamination stack having faces and edges, said lamination stack having corresponding faces and edges, and said lamination stack resides in said clamp with said pair of opposed faces engaging edges of said stack.

According to a further aspect said faces converge at a taper of about 3 degrees.

According to a further aspect one said face is substantially perpendicular to said axis of reciprocation, and the other said face is at an angle to said perpendicular to result in said taper.

According to a further aspect said laminations of said lamination stack have an edge to face said air gap and an edge adjacent each clamp face, one said clamp face edge being substantially perpendicular to said air gap edge and one said clamp face edge including a flared outward portion.

Accordingly to a further aspect said flared outward edge portion is at an angle of about 93 degrees to said air gap edge.

In a further aspect the invention consists in a method of manufacturing a linear compressor comprising:

taking up a cylinder part including an integral tapered clamp which widens outward away from an intended air gap, installing a piston and connecting rod assembly such that an armature on said piston rod is present in said air gap and is laterally supported, forcing a stator part having a taper complementary to the taper of said tapered clamp, into said tapered clamp.

According to a further aspect said cylinder part, said tapered clamp and/or said stator part are in accordance with anyone of the above paragraphs.

In relation to the invention as set forth in any of the above paragraphs said main spring may for example comprise a combination of coil springs, a combination of coil springs and planar springs or a combination of planar springs. Coil springs may be formed from suitable high fatigue wire or springs machined from thin walled cylinder stock. Preferably the combination includes at least one planar spring element contributing higher lateral stiffness. Most preferably the combination includes at least one planar spring and at least one coil spring.

There may be a lateral support acting between said cylinder part and said connecting member, at a location intermediate said permanent magnet material and said piston, said lateral support allowing axial movement of said connecting rod, but transferring side loads to said cylinder part.

In relation to the invention as set forth in the above paragraph said main spring may comprise a single spring element or a combination of a plurality of spring elements acting in parallel. Preferably the main spring also provides lateral support acting between said cylinder part and said connecting member, at a location such that said armature pole or poles are between said main spring location and said lateral support located so that the armature of said motor is supported at one end by said main spring and at the other end by said lateral support.

The lateral support may comprise one or more planar springs, for example cut from sheet material or formed from spring wire bent into a spring line within a plane. Alternatively said radial support may comprise one or more sliding beatings acting on the connecting member.

In the region of the connecting member between the lateral support and the piston the connecting member may be laterally flexible or include one (or preferably two) flexible portion, so as to effectively transmit axial forces but to have lateral and angular compliance of the piston relative to the axis and line of reciprocation of the connecting member.

The cylinder part may include provision for aerostatic gas bearings receiving compressed gases and supplying these through a plurality of spaced bearing ports spaced along and around the cylinder bore to support the piston in operation.

However the armature radially (or laterally) supported at both ends and compliancy in the connecting member between the lateral support and the piston the inventors expect that the benefits of the gas bearings and reduced friction may be exceeded by the consumption of compressed gas in the gas bearings.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

FIG. 1 is a cross-section taken through line DD of FIG. 2.

FIG. 3 is a cross-section taken through line EE of FIG. 4.

FIG. 5 is a cross-section taken through line FF of FIG. 6.

DETAILED DESCRIPTION

Figure 1:
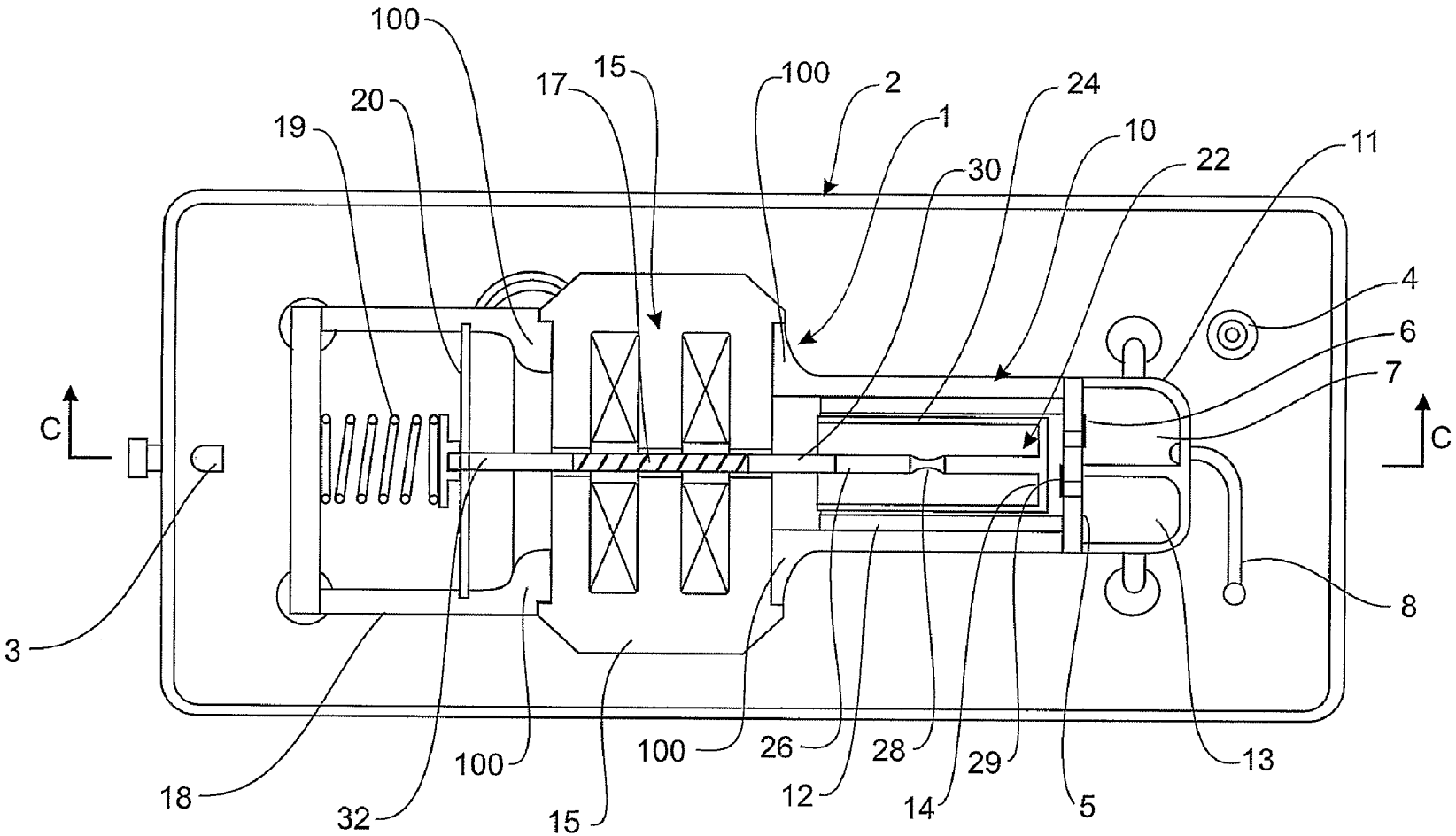
FIG. 1 is a plan elevation in cross-section of a linear compressor according to a first embodiment. The first embodiment has a main spring comprising a combination of a flat spring and a coil spring. The flat motor armature is radially supported at one end by the main spring and at the other end by the piston.

In a first aspect the invention consists in a linear compressor comprising:

a cylinder part including a cylinder bore, a piston disposed in said bore and slidable therein, a main spring connecting directly or indirectly said cylinder part to said piston, a connecting member connecting between said main spring and said piston, a stator having an air gap, said connecting member passing through said air gap, at least one armature pole located along said connecting member, wherein said stator comprises a plurality stator parts opposed across said air gap, each said cylinder part including a tapered clamp for each said stator part, said tapered clamp widening outward from said air gap;

each said stator part having a matching taper and being engaged in a said tapered clamp.

According to a further aspect at least one armature pole comprises one or more substantially flat blocks of permanent magnet material secured to said connecting member with the large faces of said blocks facing the stator, said permanent magnet material magnetised to define said armature poles.

According to a further aspect said tapered clamp includes at least one pair of opposed faces facing toward one another and facing in direction substantially parallel to the reciprocating motion of said piston is said cylinder, said opposed faces being closer adjacent said air gap than away from said air gap.

According to a further aspect said stator part includes a lamination stack, each lamination of same lamination stack having faces and edges, said lamination stack having corresponding faces and edges, and said lamination stack resides in said clamp with said pair of opposed faces engaging edges of said stack.

According to a further aspect said faces converge at a taper of about 3 degrees.

According to a further aspect one said face is truly perpendicular to said axis of reciprocation, and the other said face is at an angle to said perpendicular to result in said taper.

According to a further aspect said laminations of said lamination stack have an edge to face said air gap (which is discontinuous) and an edge adjacent each clamp face, one said clamp face edge being perpendicular to said air gap edge and one said clamp face edge including a tapered (flared) outward portion.

Accordingly to a further aspect said flared outward edge portion is at an angle of about 93 degrees to said air gap edge.

In a further aspect the invention consists in a method of manufacturing a linear compressor comprising:

taking up a cylinder part including an integral tapered clamp which widens outward away from an intended air gap, installing a piston and connecting rod assembly such that an armature on said piston rod is present in said air gap and is laterally supported, forcing a stator part having a taper complementary to the taper of said tapered clamp, into said tapered clamp.

According to a further aspect said cylinder part, said tapered clamp and/or said stator part are in accordance with any one of the above paragraphs.

In relation to the invention as set forth in any of the above paragraphs said main spring may for example comprise a combination of coil springs, a combination of coil springs and planar springs or a combination of planar springs. Coil springs may be formed from suitable high fatigue wire or springs machined from thin walled cylinder stock. Preferably the combination includes at least one planar spring element contributing higher lateral stiffness. Most preferably the combination includes at least one planar spring and at least one coil spring.

There may be a lateral support acting between said cylinder part and said connecting member, at a location intermediate said permanent magnet material and said piston, said lateral support allowing axial movement of said connecting rod, but transferring side loads to said cylinder part.

In relation to the invention as set forth in the above paragraph said main spring may comprise a single spring element or a combination of a plurality of spring elements acting in parallel. Preferably the main spring also provides lateral support acting between said cylinder part and said connecting member, at a location such that said armature pole or poles are between said main spring location and said lateral support located so that the armature of said motor is supported at one end by said main spring and at the other end by said lateral support.

The lateral support may comprise one or more planar springs, for example cut from sheet material or formed from spring wire bent into a spring line within a plane. Alternatively said radial support may comprise one or more sliding bearings acting on the connecting member.

In the region of the connecting member between the lateral support and the piston the connecting member may be laterally flexible or include one (or preferably two) flexible portion, so as to effectively transmit axial forces but to have lateral and angular compliance of the piston relative to the axis and line of reciprocation of the connecting member.

The cylinder part may include provision for aerostatic gas bearings receiving compressed gases and supplying these through a plurality of spaced bearing ports spaced along and around the cylinder bore to support the piston in operation. However the armature radially (or laterally) supported at both ends and compliancy in the connecting member between the lateral support and the piston the inventors expect that the benefits of the gas bearings and reduced friction may be exceeded by the consumption of compressed gas in the gas bearings.

Referring to FIGS. 1 to 6 the compressor for a vapour compression refrigeration system includes a linear compressor 1 supported inside a housing 2. Typically the housing 2 is hermetically sealed and includes a gases inlet port 3 and a compressed gases outlet port 4. Uncompressed gases flow within the interior of the housing surrounding the compressor 1. These uncompressed gases are drawn into the compressor during intake stroke, compressed between the piston crown 14 and valve plate 5 on the compression stroke and expelled through discharge valve 6 into a compressed gases manifold 7. Compressed gases exit the manifold 7 to the outlet port 4 in the shell through a flexible tube 8. To reduce the stiffness effect of discharge tube 8, the tube is preferably arranged as a loop or spiral transverse to the reciprocating axis of the compressor. Intake to the compression space may be through the piston (with an aperture and valve in the crown) or through the head, divided to include suction and discharge manifolds and valves. The illustrated compressors have suction through the head, with suction manifold 13 and suction valve 29.

The illustrated linear compressor 1 has, broadly speaking, a cylinder part and a piston part connected by a main spring. The cylinder part includes cylinder housing 10, cylinder head 11, valve plate 5 and a cylinder 12. The cylinder part also includes stator parts 15 for a linear electric motor. An end portion 18 of the cylinder part, distal from the head 11, mounts the main spring relative to the cylinder part. In the embodiment illustrated in FIGS. 1 and 2 and the embodiment illustrated in FIGS. 5 and 6, the main spring is formed as a combination of coil spring 19 and flat spring 20. In the embodiment illustrated in FIGS. 3 and 4 the main spring comprises a stack of a plurality of planar springs 16.

The piston part includes a hollow piston 22 with sidewall 24 and crown 14. A rod 26 connects between the crown 14 and a supporting body 30 for linear motor armature 17. The linear motor armature 17 comprises a body of permanent magnet material (such as ferrite or neodymium) magnetised to provide one or more poles directed transverse to the axis of reciprocation of the piston within the cylinder liner. An end portion 32 of armature support 30, distal from the piston 22, is connected with the main spring.

Figure 2:
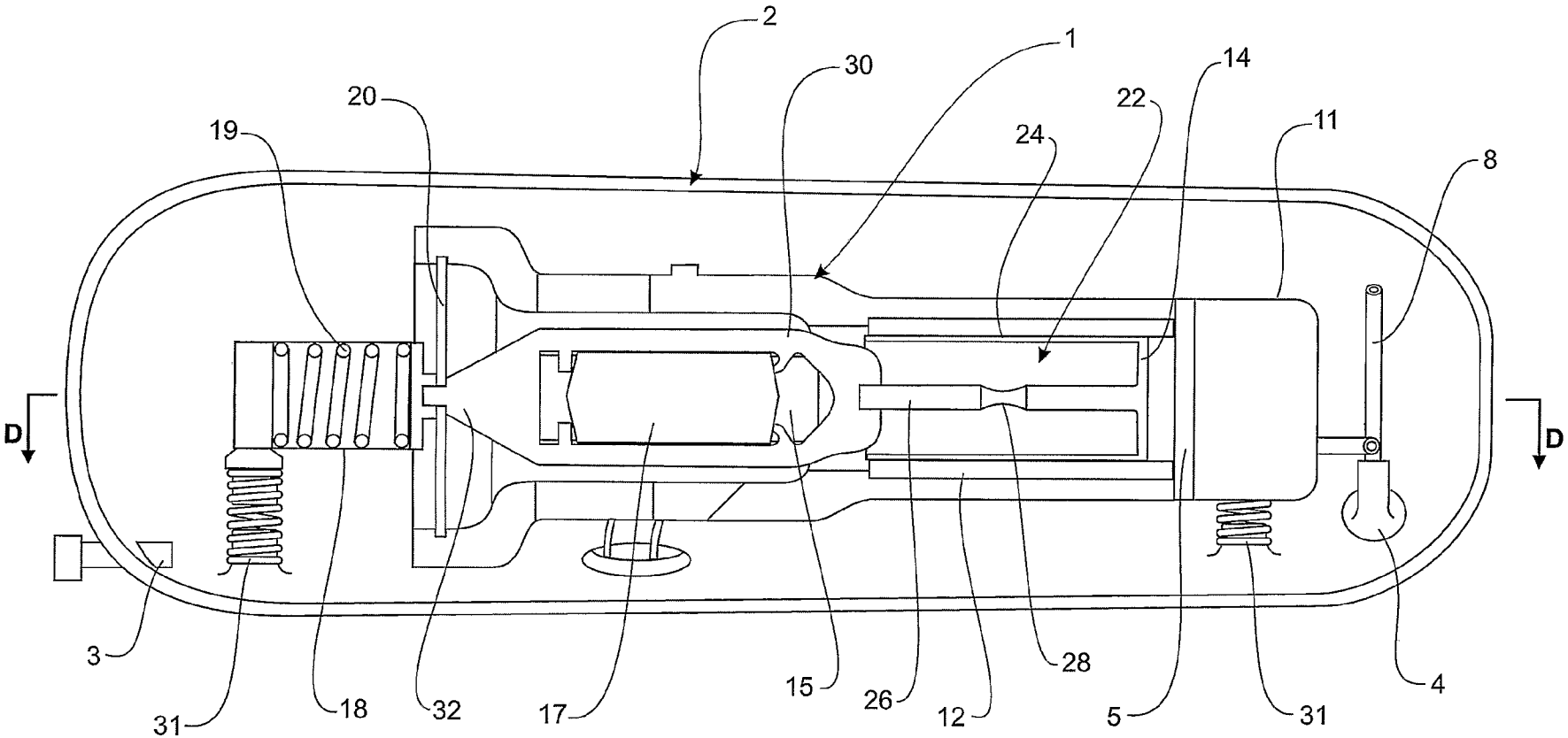
FIG. 2 is a side elevation in cross-section of the embodiment of FIG. 1, taken through line CC of FIG. 1.
Figure 3:
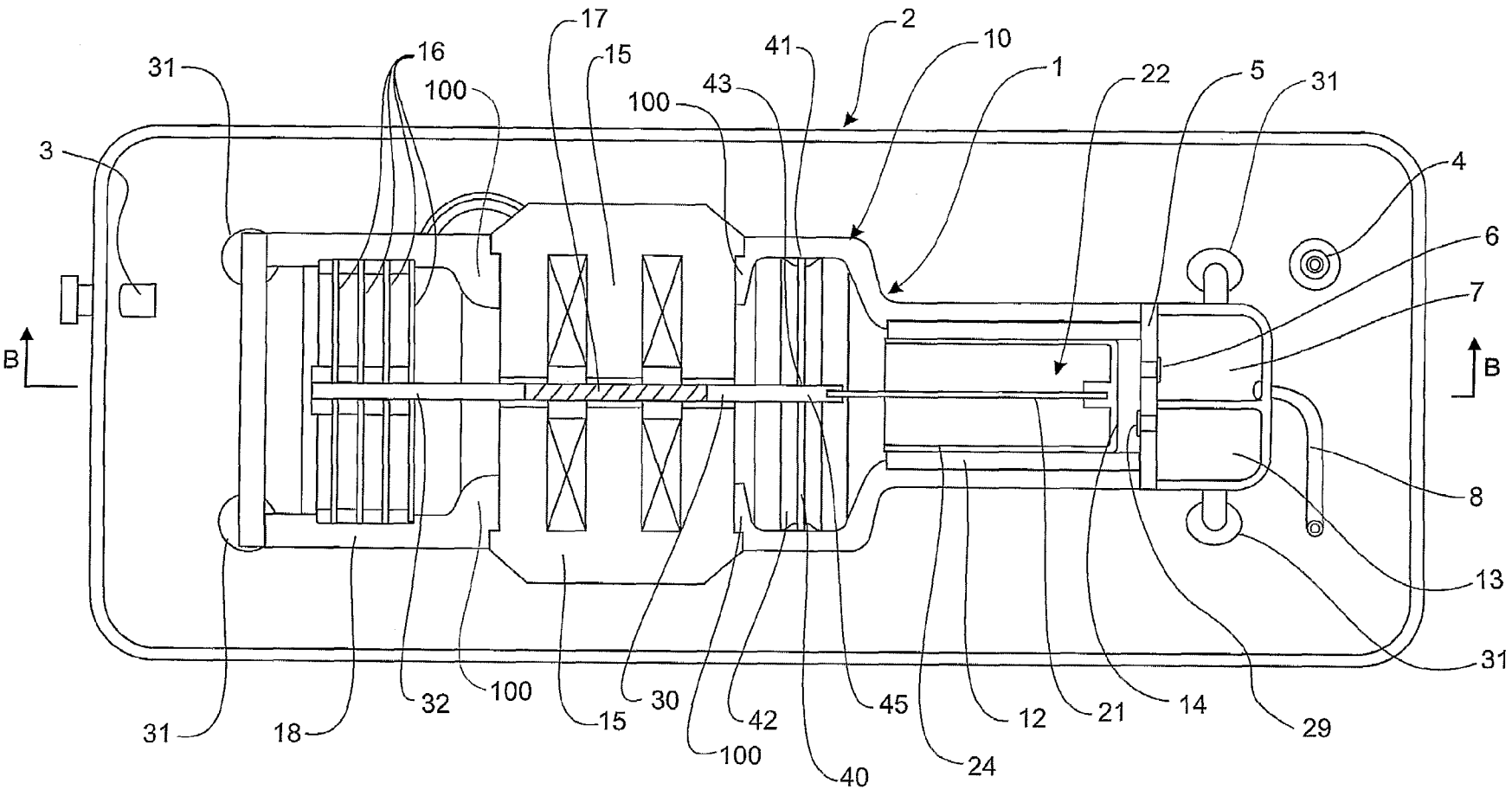
FIG. 3 is a plan elevation in cross-section of a linear compressor according to a second embodiment. The second embodiment has a main spring comprising a stack of flat springs. The flat motor armature is radially supported at one end by the main spring and at the other end by another flat spring. There is a compliant connection to the piston.
Figure 4:
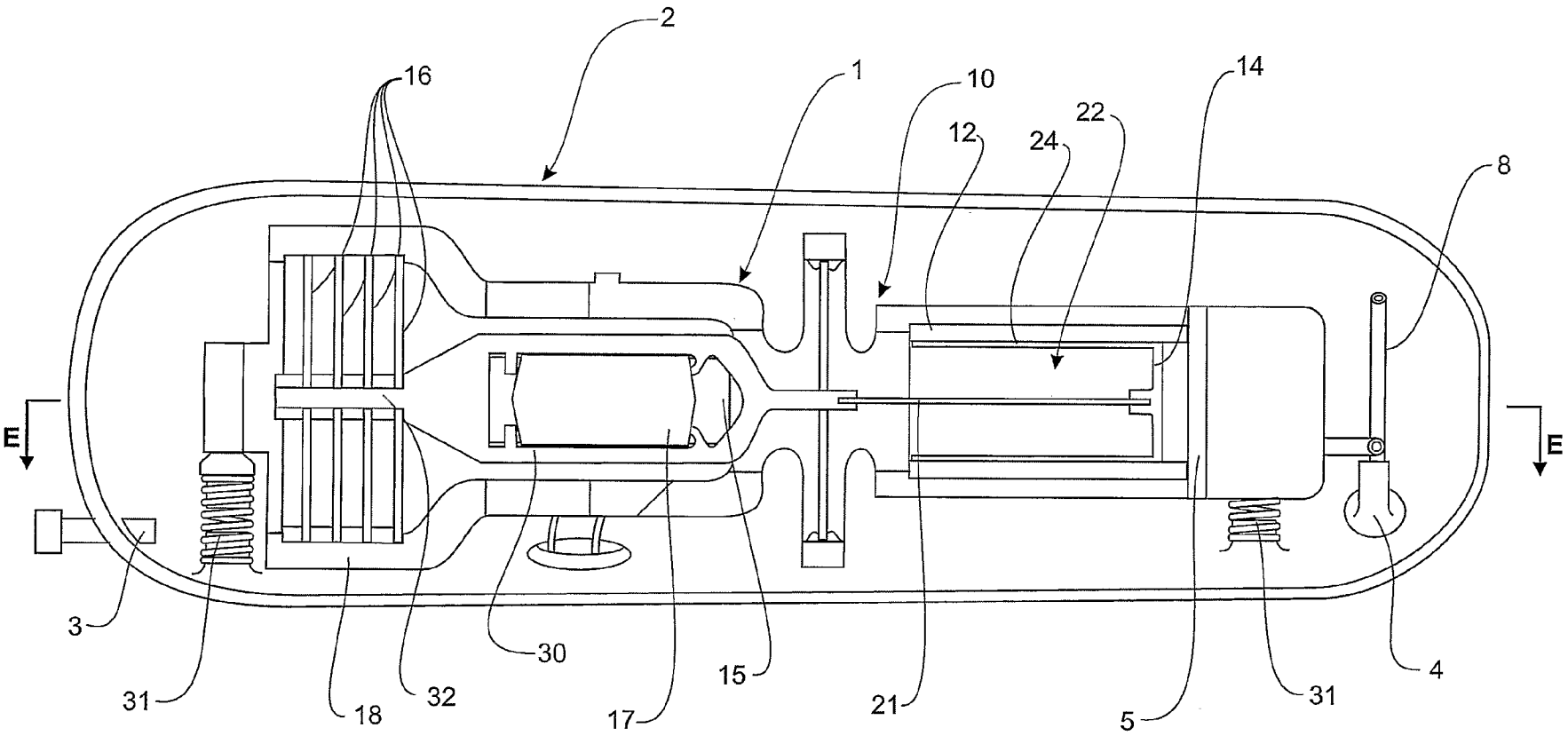
FIG. 4 is a side elevation in cross-section of the embodiment of FIG. 2, taken through line BB of FIG. 3.

In the embodiment of FIGS. 1 and 2 the rod 26 has a flexible portion 28, located at approximately the centre of the hollow piston 22. In the embodiment of FIGS. 3 and 4 and the embodiment of FIGS. 5 and 6 the rod 21 is narrow over its whole length.

The linear compressor 1 is mounted within the shell 2 on a plurality of suspension springs to isolate it from the shell. In use the large outer body of the linear compressor, the cylinder part, will oscillate along the axis of reciprocation of the piston part within the cylinder part. In the preferred compressor the piston part is purposely kept very light compared to the cylinder part so that the oscillation of the cylinder part is small compared with the relative reciprocation between the piston part and cylinder part. In the illustrated form the linear compressor is mounted on a set of four suspension springs 31 generally positioned around the periphery. Alternate suspension spring arrangements are illustrated in PCT/NZ2004/000108. The ends of each suspension spring fit over elastomeric snubbers connected with the linear compressor 1 at one end of each spring and connected with the compressor shell 2 at the other end of each spring.

Referring to the compressor embodiment of FIGS. 1 and 2, this illustrates a variation of a compressor of a type disclosed in our earlier patent application, PCT/NZ2000/000201. In that application we disclosed a compressor including a linear motor with a substantially flat permanent magnet armature operating in an air gap of a stator carried by the cylinder part. The flat armature was positioned part way along a connecting member extending from the piston, to one side of the stator, to the main spring, on the other side of the stator. The connecting member, and therefore the side forces exerted by the linear electric motor, were laterally supported at one end by the piston within the cylinder and at the other end by the lateral stiffness of the main spring.

In that earlier PCT application we disclosed a main spring of substantially singular construction involving a double helical loop of heavy gauge high fatigue strength steel wire. This main spring provides sufficient lateral stiffness and appropriate axial stiffness in a single essentially unitary element, and is another example of spring suitable in the present invention.

Other variations of main spring involve a plurality of separate spring elements working in combination. For example in the embodiment of FIGS. 1 and 2 and the embodiment of FIGS. 5 and 6 the main spring comprises a combination of a coil spring 19 and a planar spring 20. The planar spring 20 provides the lateral stiffness, while the coil spring 19 may add any desired additional axial stiffness. The planar spring 20 may be of any conventional form, for example cut from a spring steel sheet, or may be of a form such as illustrated in our earlier patent application, PCT/NZ2000/000202.

Another embodiment is disclosed with reference to FIGS. 3 and 4 in which the main spring comprises the combined stack of four planar springs 16 all operating together. In this case each of the planar springs offers both lateral stiffness and axial stiffness. Planar springs are generally very stiff laterally compared with their axial stiffness and an embodiment as illustrated in FIGS. 3 and 4 will probably exhibit unnecessarily high lateral stiffness to obtain a suitable axial stiffness, although it would be appreciated that the desired axial stiffness will depend on the desired running speed for the compressor.

The embodiments of FIGS. 3 and 4 and FIGS. 5 and 6 illustrate a further variation. In the compressor embodiment of FIGS. 1 and 2 and in the aforementioned patent application PCT/NZ2000/000201, the piston rod, carrying the armature 17, is supported against lateral loading by the main spring at one end and through the piston at the other end. This is desirable for its compactness and simplicity however it does result in increased side loading of the piston within the cylinder bore. This extra side loading can be managed and examples of how to manage it are given in our patent applications, including in relation to the embodiment of FIGS. 1 and 2 herein.

However the embodiments of FIGS. 3 and 4 and 5 and 6 herein include an alternative approach to dealing with the lateral forces resulting from the flat permanent magnet linear motor, where the motor is located on the member connecting between the main spring and the piston.

According to this approach a radial or lateral support is provided to act between the cylinder part 1 and the connecting member at a location between the armature magnets and the piston. The support transmits the side loads from the connecting member directly to the cylinder part 10.

In the embodiment of FIGS. 3 and 4 the radial support comprises a planar spring 40 connected at its outer edge 41 to said cylinder part 10 and at its hub 43 to an end 45 of the armature supporting body 30. The planar spring 40 offers substantial lateral stiffness and the armature supporting body 30 is substantially rigid. Accordingly the lateral loads from the flat permanent magnetic linear electric motor, which can be substantial, are supported at one end by flat spring 40 and at the other by the main spring, which includes further planar springs 16. The planar spring 40 may be mounted within an annular ring portion 42 of cylinder part 10.

Figure 5:
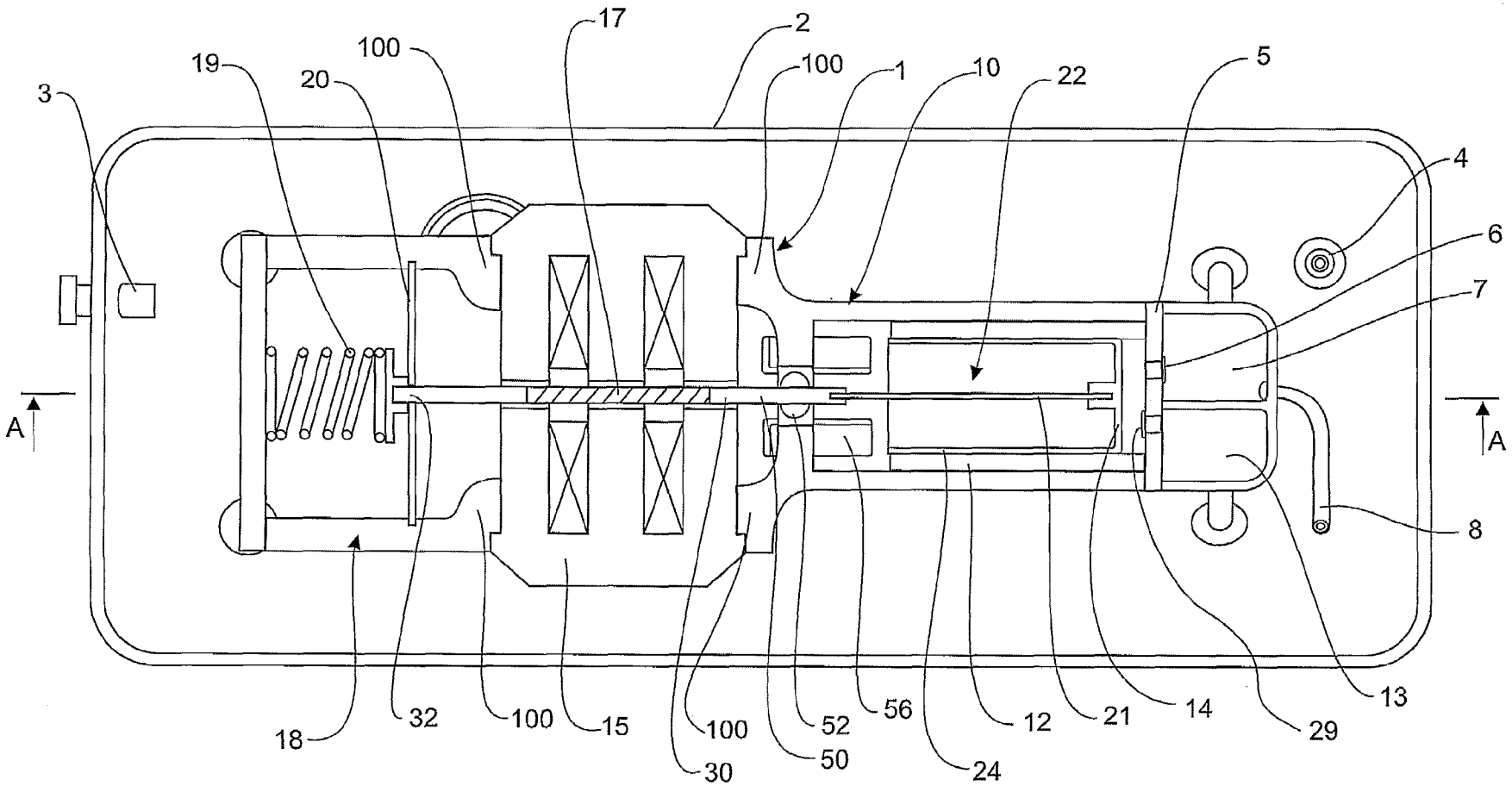
FIG. 5 is a plan elevation in cross-section of a linear compressor according to a third embodiment. The third embodiment has a main spring comprising a combination of a flat spring and a coil spring. The flat motor armature is radially supported at one end by the main spring and at the other end in a sliding bearing. There is a compliant connection to the piston.
Figure 6:
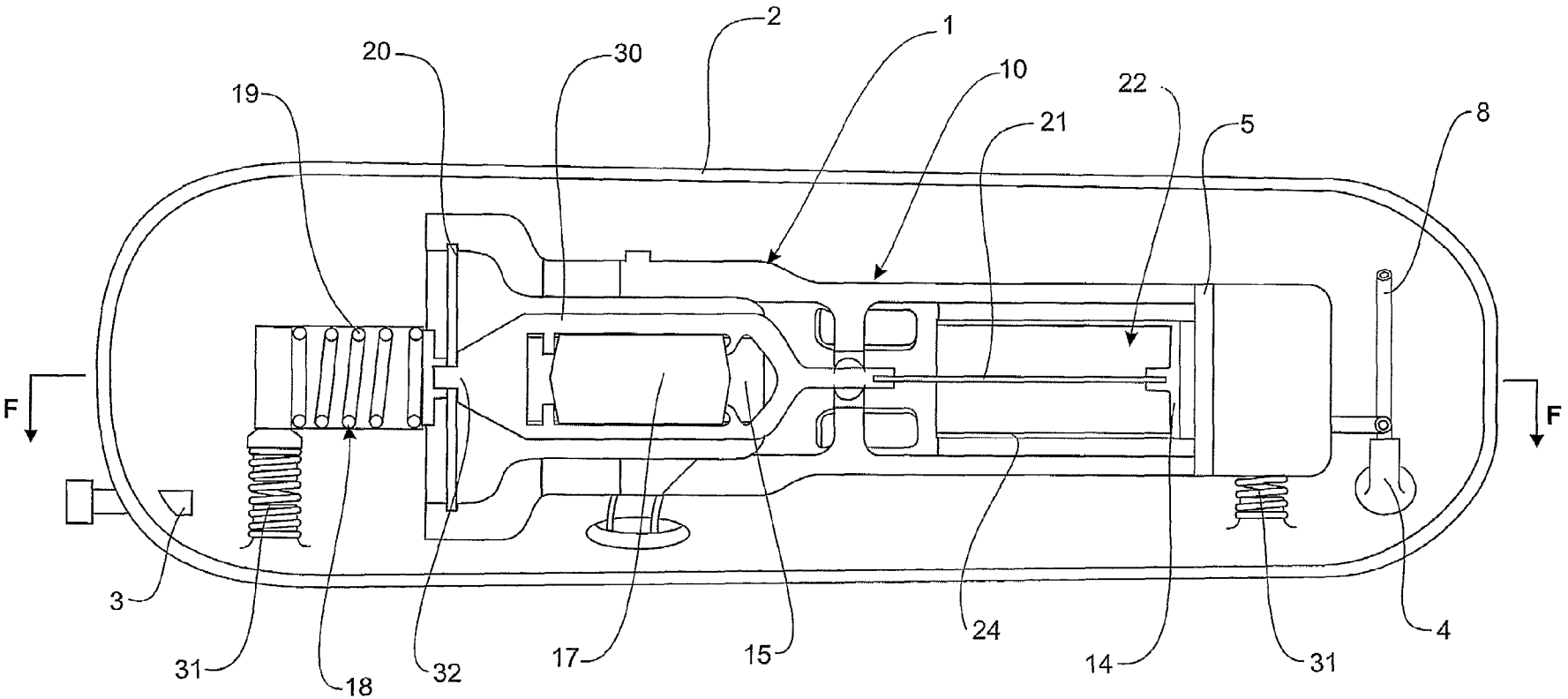
FIG. 6 is a side elevation in cross-section of the embodiment of FIG. 5, taken through line AA of FIG. 5.

In an alternative embodiment illustrated in FIGS. 5 and 6 the lateral support is provided by an axial sliding bearing. The end portion 50 of armature support member 30 is formed to provide a substantially cylinder shaft of constant diameter. This shaft portion passes through a sliding bearing 52 forming part of the cylinder part 10. The sliding bearing 52 may for example comprise a bush of a suitable low friction hardwearing material. The bush may for example be a spherical bush of PTFE plastic material (or similar) retained within a suitable internally spherical housing. This arrangement will also allow for certain misalignment of the armature support member 30 relative to the cylinder part 10.

It is preferred in either case to retain reasonable gas flow in the vicinity of the armature. Accordingly an open frame construction, such as illustrated in FIGS. 4 and 5, is used to support the lateral support (e.g. planar spring or sliding bearing) relative to the cylinder part 10. Alternatively a plurality of windows or apertures, such as openings 56 in FIGS. 5 and 6 may be provided which communicate both with the region of the cylinder part housing the linear electric motor and with the region of the cylinder part housing the cylinder and piston. This gases flow capability into the inside of the cylinder part 10 is also useful to reduce any gas pressure effects on the back face of the piston 22 and to provide gas flow paths to the back face of piston 22 in embodiments where suction gases flow is provided through the crown of the piston rather than through the compressor head.

In the embodiments of FIGS. 3 to 6 where the armature supporting member 30 is fully supported against lateral loading, a preferred connection between the armature supporting member 30 and the piston 22 has considerable lateral compliancy while retaining axial stiffness. A suitable linkage would include a narrow metal rod embedded at one end in the end of the armature supporting member 30 and at the other end in the piston crown 14. The thin rod 21 should have sufficient compliancy to allow the orientation of piston 22 to adapt to any misalignment between the armature support member 30 and the cylinder 12, and sufficient axial stiffness that it will not buckle as the linear motor and springs drive the piston toward the cylinder head during the compression stroke of the compressor in operation.

While a compressor according to these embodiments, where the flat permanent magnetic armature is fully supported, may still provide for aerostatic gas bearings to operate between the cylinder 12 and piston 22 it is expected that the side loads from the piston 22 to the cylinder 12 will be very low. With modern hardware and coatings the arrangement may operate effectively and with sufficient longevity without either oil lubrication or aerostatic bearings.

Figure 7:
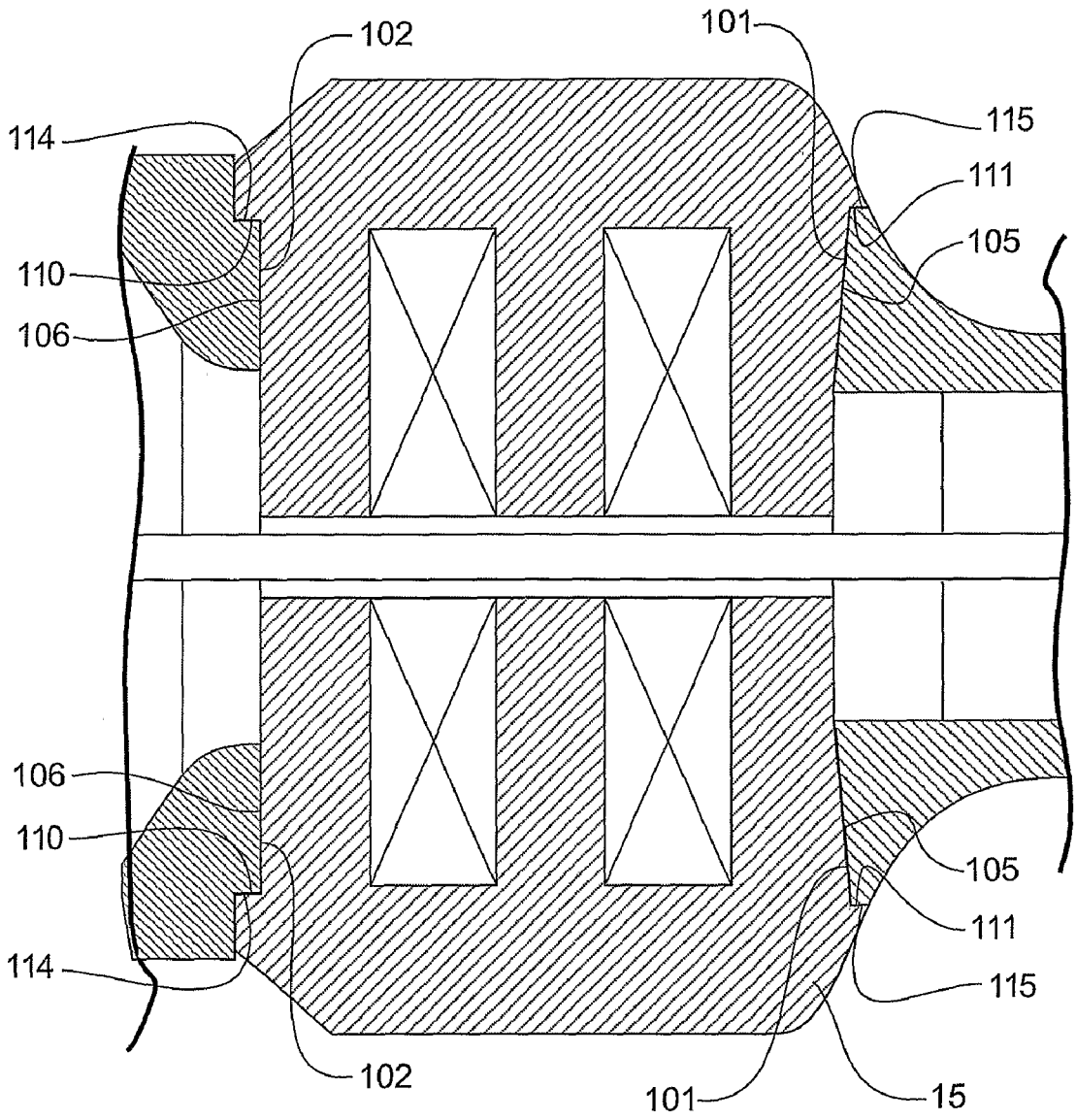
FIG. 7 is an expanded view of the integral stator mounting clamp and associated stator part, according to the present invention as included in each of the embodiments.

In each of the embodiments, FIGS. 1 and 2, FIGS. 3 and 4 or FIGS. 5 and 6, the cylinder part includes an integral stator clamp 100 for each stator part 15. The stator clamp and associated stator part are illustrated in more detail in FIG. 7. The integral stator clamp 100 comprises a pair of opposed clamp faces 101, 102. The clamp faces are axially separated relative to the axis of the compressor, and the respective stator part is accommodated between the faces. The planes of faces are generally perpendicular to the axis of the reciprocation of the piston, however between them they define a tapered opening from the outside of the compressor assembly found in the air gap. The angle of taper is preferably about 3 degrees. The respective stator part includes a complementary taper between its ends 105, 106. The stator part is jammed into the opening between the clamp faces 101, 102 and held in place purely on the basis of this interface and any attraction to the permanent magnet motor armature.

The 3 degrees convergence of the clamp faces is dependent on the materials of the cylinder part and the stator part and on the rigidity of the cylinder part. This taper angle is preferably extended in one of the clamp faces, for example clamp face 101, and correspondingly in one of the stator ends, for example end 105. In this form the other clamp face 102 and stator part end 106 are truly perpendicular to the axis of reciprocation.

The stator part has a stack of individual laminations carrying a winding coil. The individual laminations may be, for example, E-shaped, with the laminations stacked and secured together for example by rivets, the coil passes around the central leg of the E. The coil may be wound on an insulative bobbin, subsequently fitted over the central leg of the E. The stator laminations have faces and edges, and the lamination stack has corresponding faces and edges. One (discontinuous) edge of each lamination stack faces the air gap. Two edges 105, 106 of the lamination stack are jammed against the clamp faces 101, 102. The remaining edge faces away from the air gap.

The edges 105, 106 preferably include respective knees 110, 111. The knees 110, 111 abut shoulders 114, 115 of the cylinder part and limit the depth of insertion of the stator part into the integral clamp.

The invention claimed is:

1. A linear compressor comprising:

a cylinder part including a cylinder bore, a piston disposed in said bore and slidable therein, a main spring connecting said cylinder part to said piston, a connecting member connecting between said main spring and said piston, at least two stator parts of a linear electric motor, said at least two stator parts defining an air gap, said connecting member passing through said air gap, said connecting member having at least one armature pole, wherein said at least two stator parts comprises are opposed across said air gap, said cylinder parts further including a tapered clamp for each of said stator parts, said tapered clamp widening outward from said air gap;

each of said at least two stator parts having a matching taper and being engaged in said tapered clamp.

2. A compressor as claimed in claim 1 wherein at least one armature pole comprises one or more substantially flat blocks of permanent magnet material secured to said connecting member with the large faces of said blocks facing the at least two stator parts, said permanent magnet material magnetised to define said armature poles.

3. A compressor as claimed in claim 1 wherein said tapered clamp includes at least one pair of opposed faces facing toward one another and facing in a direction substantially parallel to the reciprocating motion of said piston in said cylinder, said opposed faces being closer adjacent said air gap than away from said air gap.

4. A compressor as claimed in claim 3 wherein each of said stator parts has faces and edges, and each said stator part resides in said clamp with said pair of opposed faces engaging said edges of said stator parts.

5. A compressor as claimed in claim 3 wherein said faces converge at a taper of about 3 degrees.

6. A compressor as claimed in claim 3 wherein one said face is substantially perpendicular to said axis of reciprocation, and the other said face is at an angle to said perpendicular to result in said taper.

7. A compressor as claimed in claim 3 wherein each said stator part has an edge to face said air gap and an edge adjacent each clamp face, one said clamp face edge being substantially perpendicular to said air gap edge and one said clamp face edge including a flared outward portion.

8. A compressor as claimed in claim 7 wherein said flared outward edge portion is at an angle of about 93 degrees to said air gap edge.

9. A compressor as claimed in any one of claims 1 to 8 wherein there are no other means of securing said stator to said cylinder part.

10. A compressor as claimed in claim 1 wherein said cylinder part includes at least one shoulder facing away from said air gap, and said stator part includes at least one protruding knee, butting against said outwardly facing shoulder of said cylinder part.

11. A method of manufacturing a linear compressor comprising:

taking up a cylinder part including an integral tapered clamp which widens outward away from an air gap, installing a piston and connecting rod assembly such that an armature on said piston rod is present in said air gap and is laterally supported, forcing a stator part having a taper complementary to the taper of said tapered clamp, into said tapered clamp.

12. A method as claimed in claim 11 wherein said stator parts are forced into said tapered clamp until a knee on said stator part buts against a shoulder on said cylinder part.

13. A method as claimed in claim 11 wherein said stator parts are secured to said cylinder part by jamming and any magnetic attraction toward said armature.

14. A linear compressor comprising:

a cylinder part including a cylinder bore, a piston disposed in said bore and slidable therein, a main spring connecting said cylinder part to said piston, a connecting member connecting between said main spring and said piston, a stator of a linear electric motor, said stator having an air gap, said connecting member passing through said air gap, at least one armature pole of said linear electric motor located along said connecting member, wherein said stator comprises a plurality stator parts opposed across said air gap, said cylinder part comprising a fixed pair of opposed clamp faces axially separated relative to the axis of the compressor, and at least one clamp face defining a taper widening outward from said armature pole, and at least one said stator part having a matching taper, said taper jamming said stator part in said tapered clamp by a force acting, or having acted, toward said armature pole.

15. A compressor as claimed in claim 14 wherein said taper is about 3 degrees.

16. A compressor as claimed in claim 14 wherein each stator comprises an E-shaped former.

17. A compressor as claimed in claim 14 wherein faces of said former perpendicular to said discontinuous face engages with said clamp.

18. A linear compressor comprising:

a cylinder part including a cylinder bore, a piston disposed in said bore and slidable therein, a main spring connecting said cylinder part to said piston, a connecting member connecting between said main spring and said piston, a stator of a linear electric motor, said stator having an air gap, said connecting member passing through said air gap, at least one armature pole of said linear electric motor located along said connecting member, wherein said stator comprises a plurality stator parts, said stator parts comprising a pair of E-shaped formers and a coil wrapped around the central leg of each E-shaped former, the discontinuous face of each E-shaped former opposed across said air gap, wherein said cylinder part includes a clamp for each said E-shaped former, said clamp tapering outward from said armature pole and each E-shaped former having a matching taper on the surfaces engaging said tapered clamp.

19. A compressor as claimed in claim 18 wherein each E-shaped former is a stack of E-shaped formers.

20. A compressor as claimed in claim 18 wherein faces of each said former perpendicular to said discontinuous face engage with said clamp.

* * * * *

UNITED STATES PATENT AND TRADEMARK OFFICE

CERTIFICATE OF CORRECTION

PATENT NO. : 8,177,523 B2
APPLICATION NO. : 11/995991
DATED : May 15, 2012
INVENTOR(S) : Patel et al.

It is certified that error appears in the above-identified patent and that said Letters Patent is hereby corrected as shown below:

Column 2, Line 27 “anyone” should be -- “any one”. --

Column 2, Line 57 “beatings” should be -- “bearings”. --

Signed and Sealed this
Ninth Day of April, 2013

Teresa Stanek Rea
*Acting Director of the United States Patent and Trademark Office*